US007608378B2

(12) United States Patent
Urabe et al.

(10) Patent No.: US 7,608,378 B2
(45) Date of Patent: Oct. 27, 2009

(54) DEVELOPING AGENT AND METHOD FOR MANUFACTURING THE SAME

(75) Inventors: Takashi Urabe, Sunto-gun (JP); Tsuyoshi Ito, Izunokuni (JP); Motonari Udo, Mishima (JP); Masahiro Ikuta, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 379 days.

(21) Appl. No.: 11/445,865

(22) Filed: Jun. 2, 2006

(65) Prior Publication Data

US 2007/0281240 A1 Dec. 6, 2007

(51) Int. Cl.
*G03G 9/00* (2006.01)

(52) U.S. Cl. ..... 430/137.14; 430/137.19

(58) Field of Classification Search ..... 430/137.14, 430/137.19

See application file for complete search history.

(56) References Cited

U.S. PATENT DOCUMENTS

| | | | | |
|---|---|---|---|---|
| 5,308,734 | A * | 5/1994 | Sacripante et al. | 430/137.14 |
| 2004/0048182 | A1 * | 3/2004 | Urabe | 430/110.2 |
| 2005/0196694 | A1 * | 9/2005 | Yuasa et al. | 430/108.4 |

FOREIGN PATENT DOCUMENTS

| | | |
|---|---|---|
| JP | 63-282752 | 11/1988 |
| JP | 06-250439 | 9/1994 |
| JP | 09-311502 | 12/1997 |
| JP | 2001-027825 | 1/2001 |
| JP | 2004-325510 | 11/2004 |

* cited by examiner

*Primary Examiner*—John L Goodrow
(74) *Attorney, Agent, or Firm*—Turocy & Watson, LLP

(57) ABSTRACT

A method for manufacturing a developing agent by mixing a coarsely granulated mixture containing a binder resin and a coloring agent with an aqueous medium and mechanically stirring the resulting mixed solution to finely granulate the coarsely granulated mixture, thereby forming a fine particle.

16 Claims, 1 Drawing Sheet

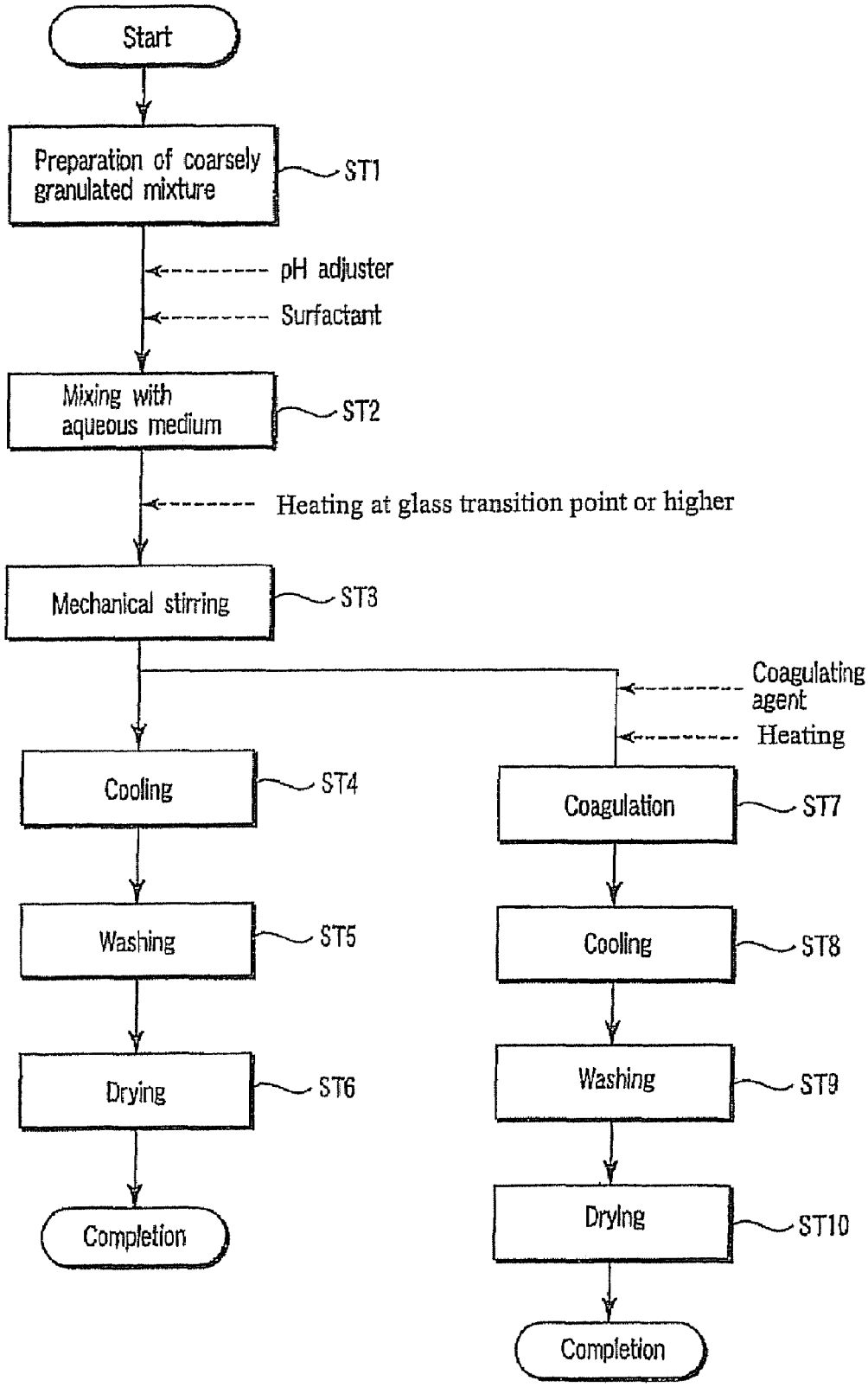
FIGURE

DEVELOPING AGENT AND METHOD FOR MANUFACTURING THE SAME

BACKGROUND OF THE INVENTION

In the electrophotography, an electrical latent image is formed on an image carrier, the latent image is subsequently developed with a toner, and a toner image is transferred on a transfer material such as paper and then fixed by means of heating, pressurization, and so on. With respect to the toner to be used, in order to form not only a conventional monochromic black image but also a full color image, the image is formed by using toners of plural colors.

The toner includes a two-component system developing agent which is used upon mixing with a carrier particle and a single-component system developing agent which is used as a magnetic toner or a non-magnetic toner. With respect to the manufacturing method of such a toner, the toner is usually manufactured by a kneading and pulverization method. This kneading and pulverization method is a method for manufacturing a desired toner particle by melt kneading a binder resin, a pigment, a mold releasing agent such as waxes, a charge controlling agent, and so on and after cooling, finely pulverizing the mixture, followed by classification. An inorganic and/or organic fine particle is added on the surface of the toner particle as manufactured by the kneading and pulverization method according to the purpose, thereby obtaining a toner.

In the case of a toner particle as manufactured by the kneading and pulverization method, it is difficult to intentionally control the shape. Also, in particular, in the case of using a material with high pulverization properties, the material is liable to be finely divided. Thus, in the two-component system developing agent, the finely divided toner stuck fast to the carrier surface, thereby accelerating charge deterioration of the developing agent; and in the single-component system developing agent, the finely divided toner was scattered or developability was lowered with a change of the toner shape, resulting in deterioration of the image quality. Also, when pulverization occurs on the interface between the binder resin and the wax, the wax was separated from the toner, thereby readily generating contamination on a developing roll, an image carrier, a carrier, etc., resulting in a possible lowering of reliability as the developing agent.

Under these circumstances, in recent years, as a method for manufacturing a toner in which the shape and surface composition of the toner particle are intentionally controlled, an emulsion polymerization coagulation method is proposed in JP-A-63-282752 and JP-A-6-250439.

The emulsion polymerization coagulation method is a method in which a resin dispersion is prepared by emulsification polymerization, whereas a coloring agent dispersion having a coloring agent dispersed in a solvent is prepared, and these are mixed to form a coagulated particle corresponding to the toner particle diameter, followed by fusion by heating to obtain a toner particle. According to this emulsion polymerization coagulation method, by selecting a heating temperature condition, it is possible to arbitrarily control the toner shape from an amorphous form to a spherical form.

According to the emulsion polymerization coagulation method, it is possible to obtain a toner by coagulating and fusing at least a dispersion of a resin fine particle and a dispersion of a coloring agent under a prescribed condition. However, the emulsion polymerization coagulation method is restricted with respect to the kind of a resin which can be synthesized. Though the emulsion polymerization coagulation method is suitable for manufacturing a styrene-acrylic copolymer, it cannot be applied to polyester resins which are known to have good fixability.

In contrast, as a method for manufacturing a toner using a polyester resin, there is an inverse emulsification method in which a pigment dispersion and the like are added in a solution dissolved in an organic solvent, to which is then added water. However, in this method, the organic solvent must be recovered. A method for manufacturing a fine particle by mechanical stirring in an aqueous medium without using an organic solvent is proposed in JP-A-9-311502. However, in this method, a resin in a molten state and the like must be fed into a stirring device, and handling was difficult. Also, a degree of freedom against the shape control was low so that it was impossible to arbitrarily control the toner shape from an amorphous form to a spherical form.

BRIEF SUMMARY OF THE INVENTION

In view of the foregoing background, the invention has been made, and an object thereof is to provide a method for manufacturing a developing agent capable of realizing miniaturization in size and shape control without using an organic solvent, having small scattering in the surface composition and having good fixability and transfer properties.

A method for manufacturing a developing agent of the invention is provided with a step for mixing a coarsely granulated mixture containing a binder resin and a coloring agent with an aqueous medium; and a step for mechanically stirring the subject mixed solution to finely granulate the subject coarsely granulated mixture, thereby forming a fine particle.

Also, a developing agent of the invention contains a fine particle obtained by mixing a coarsely granulated mixture containing a binder resin and a coloring agent with an aqueous medium and mechanically stirring the mixed solution.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

The single FIGURE is a flow chart to show one example of a method for manufacturing a developing agent according to the invention.

DETAILED DESCRIPTION OF THE INVENTION

A method for manufacturing a developing agent according to a first viewpoint of the invention is provided with a step for mixing a coarsely granulated mixture containing a binder resin and a coloring agent with an aqueous medium; and a step for mechanically stirring the mixed solution to finely granulate the coarsely granulated mixture, thereby forming a toner particle.

Also, a method for manufacturing a developing agent according to a second viewpoint of the invention is provided with a step for mixing a coarsely granulated mixture containing a binder resin and a coloring agent with an aqueous medium;

a step for mechanically stirring the mixed solution to finely granulate the coarsely granulated mixture, thereby forming a fine particle; and a step for coagulating the fine particle to form a toner particle.

A developing agent according to a third viewpoint of the invention contains a toner particle obtained by mixing a coarsely granulated mixture containing a binder resin and a coloring agent with an aqueous medium and mechanically stirring the mixed solution.

Also, a developing agent according to a fourth viewpoint of the invention contains a toner particle obtained by mixing a coarsely granulated mixture containing a binder resin and a coloring agent with an aqueous medium, mechanically stirring the mixed solution and coagulating the resulting fine particle.

According to the invention, by mixing a material containing a binder resin and a coloring agent with an aqueous medium and mechanically stirring the mixed solution, it becomes possible to granulate the material while finely dividing. In this way, a developing agent capable of realizing miniaturization in size and shape control without using an organic solvent, having small scattering in the surface composition and exhibiting sufficient fixability and transfer properties is obtained.

Also, by using such a developing agent, a satisfactory image can be formed.

The invention will be hereinafter described in detail with reference to the accompanying drawing.

FIGURE is a flow chart to show one example of a method for manufacturing a developing agent according to the first and second viewpoints of the invention.

As shown in the drawing, in the method for manufacturing a developing agent of the invention, first of all, a coarsely granulated mixture containing a binder resin and a coloring agent is prepared (ST1).

The coarsely granulated mixture is, for example, obtained by a step for melt kneading a mixture containing a binder resin and a coloring agent and coarsely pulverizing the mixture. Alternatively, the coarsely granulated mixture is obtained by granulating a mixture containing a binder resin and a coloring agent.

The coarsely granulated mixture preferably has a volume average particle size of from 0.05 mm to 10 mm.

When the volume average particle size is less than 0.05 mm, strong stirring is necessary for mixing with an aqueous medium, and bubbles as generated by stirring tend to lower dispersion of a mixed material. When it exceeds 10 mm, since the particle size is large as compared with a gap provided in a shear part of a mechanical stirring device, the particle is liable to cause plugging in the shear part, or particles having a non-uniform composition or particle size tend to be generated due to a difference in energy to be received between the inside and the outside of the mixture.

The coarsely granulated mixture more preferably has a volume average particle size of from 0.1 mm to 5 mm.

Next, the coarsely granulated mixture is mixed with an aqueous medium (ST2).

In the step for mixing the coarsely granulated mixture with the aqueous medium, it is possible to arbitrarily add at least one member of a surfactant and a pH adjuster in the aqueous medium.

By adding a surfactant, it is possible to readily disperse it in the aqueous medium due to an action of the surfactant as adsorbed on the surface of the mixture. Furthermore, by adding a pH adjuster, a degree of dissociation of a dissociable functional group on the surface of a mixed material is increased or polarity is enhanced so that self-dispersibility can be improved.

Subsequently, the resulting mixed solution is mechanically stirred to finely granulate the subject coarsely granulated mixture, thereby forming a fine particle (ST3).

The mechanical stirring can be carried out by heating at a temperature of a glass transition point of the binder resin or higher.

According to the invention, by carrying out mechanical stirring at a temperature of a glass transition point or higher in the aqueous medium, fluidity of the binder resin of the coarsely granulated mixture can be ensured, and the coarsely granulated mixture can be finely divided and granulated while covering the surface of the dispersed particle by a desired material. In this way, different from a toner particle as obtained by the pulverization method, a toner particle having a more uniform surface composition is obtained.

According to the invention, it is possible to control the size of the resulting fine particle by adjusting the treatment temperature and treatment time of the mechanical stirring, the revolution number of the stirring device, and so on.

The fine particle which is used in the first viewpoint of the invention preferably has a volume average particle size of from 1 to 10 μm.

After the mechanical stirring, in the case where the mixed solution contains a fine particle having a size suitable for the developing agent according to the first viewpoint, a toner particle is obtained by cooling this mixed solution to, for example, from 5° C. to not higher than the glass transition point (ST4); thereafter, washing by using, for example, a filter press (ST5); and drying (ST6).

The fine particle which is used in the second viewpoint of the invention preferably has a volume average particle size of from 0.05 to 5 μm, and by coagulating the fine particle to form a coagulated particle, it can be used as a toner particle.

In the case where the mixed solution contains a fine particle having a size suitable for the developing agent according to the second viewpoint, after the mechanical stirring, the fine particle is coagulated to form a coagulated particle (ST7).

In order to form a coagulated particle, it is possible to throw a coagulating agent into the mixed solution.

Furthermore, in order to fuse the coagulated particle, it is possible to heat this mixed solution at a temperature of, for example, from approximately 5 to 80° C. higher than the glass transition point of the binder resin.

In the step for forming a coagulated particle, it is possible to coagulate a plural number of fine particles by employing at least one process among adjustment of pH, addition of a surfactant, addition of a water-soluble metallic salt, addition of an organic solvent, and temperature adjustment. It is possible to control the shape of the coagulated particle by adjusting such a process.

The coagulated particle preferably has a volume average particle size of from 1 to 15 μm.

The coagulated particle preferably has a circularity of from 0.8 to 1.0.

After forming the coagulated particle, a toner particle is obtained by cooling this mixed solution to, for example, from 5° C. to not higher than the glass transition point (ST8); thereafter, washing by using, for example, a filter press (ST9); and drying (ST10).

Examples of the binder resin which is used in the invention include styrene based resins such as polystyrene, styrene/butadiene copolymers, and styrene/acrylic copolymers, ethylene based resins such as polyethylene, polyethylene/vinyl acetate copolymers, polyethylene/norbornene copolymers, and polyethylene/vinyl alcohol copolymers, polyester resins, acrylic resins, phenol based resins, epoxy based resins, allyl phthalate based resins, polyamide based resins, and maleic acid based resins. These resins may be used singly or in combination of two or more kinds thereof.

The binder resin preferably has an acid value of 1 or more.

Examples of the coloring agent which is used in the invention include carbon black and organic or inorganic pigments or dyes. Examples of the carbon black include acetylene black, furnace black, thermal black, channel black, and Ketjen black. Also, examples of yellow pigments include C.I. Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183 and 185 and C.I. Vat Yellow 1, 3 and 20. These can be used singly or in admixture. Also, examples of magenta pigments include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209 and 238, C.I. Pigment Violet 19, and C.I. Vat Red 1, 2, 10, 13, 15, 23, 29 and 35. These can be used singly or in admixture. Also, examples of cyan pigments include C.I. Pigment Blue 2, 3, 15, 16 and 17, C.I. Vat Blue 6, and C.I. Acid Blue 45. These can be used singly or in admixture.

At least one of a wax and a charge controlling agent can be further added in the coarsely granulated mixture.

Examples of the wax include aliphatic hydrocarbon based waxes such as low molecular weight polyethylene, low molecular weight polypropylene, polyolefin copolymers, polyolefin waxes, microcrystalline waxes, paraffin waxes, and Fischer-Tropsch waxes; oxides of an aliphatic hydrocarbon based wax such as polyethylene oxide waxes or block copolymers thereof; vegetable waxes such as candelilla wax, carnauba wax, Japan wax, jojoba wax, and rice wax; animal waxes such as bees wax, lanolin, and whale wax; mineral waxes such as ozokerite, ceresin, and petrolatum; waxes containing, as the major component, a fatty acid ester such as montanic acid ester wax and castor wax; and deoxidation products resulting from deoxidization of a part or whole of a fatty acid ester such as deoxidized carnauba wax. In addition, there are enumerated saturated linear fatty acids such as palmitic acid, stearic acid, montanic acid, and long chain alkylcarboxylic acids having a longer chain alkyl group; unsaturated fatty acids such as brassylic acid, eleostearic acid, and parinaric acid; saturated alcohols such as stearyl alcohol, eicosyl alcohol, behenyl alcohol, carnaubyl alcohol, ceryl alcohol, melissyl alcohol, and long chain alkyl alcohols having a longer chain alkyl group; polyhydric alcohols such as sorbitol; fatty acid amides such as linoleic acid amide, oleic acid amide, and lauric acid amide; saturated fatty acid bisamides such as methylenebisstearic acid amide, ethylenebiscaprylic acid amide, ethylenebislauric acid amide, and hexamethylenebisstearic acid amide; unsaturated fatty acid amides such as ethylenebisoleic acid amide, hexamethylenebisoleic acid amide, N,N'-dioleyladipic acid amide, and N,N'-dioleylsebaccic acid amide; aromatic bisamides such as m-xylenebisstearic acid amide and N,N'-distearylisophthalic acid amide; fatty acid metal salts (generally called metallic soaps) such as calcium stearate, calcium laurate, zinc stearate, and magnesium stearate; waxes resulting from grafting of a vinyl monomer such as styrene and acrylic acid on an aliphatic hydrocarbon based wax; partial esterification products between a fatty acid and a polyhydric alcohol such as behenic acid monoglyceride; and methyl ester compounds having a hydroxyl group resulting from hydrogenation of a vegetable fat and oil.

Furthermore, as the charge controlling agent for controlling a triboelectrostatic charge quantity, for example, a metal-containing azo compound is used, and complexes or complex salts in which a metal element thereof is iron, cobalt or chromium, or mixtures thereof are desired. Besides, a metal-containing salicylic acid derivative compound can be used, and complexes or complex salts in which a metal element thereof is zirconium, zinc, chromium or boron, or mixtures thereof are desired.

As the pH adjuster which can be used in the invention, it is desired to use an amine compound. Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane, and N,N-diethyl-1,3-diaminopropane.

Examples of the surfactant which can be used in the invention include anionic surfactants including sulfate based, sulfonate based, phosphate based and soap based anionic surfactants; cationic surfactants including amine salt type and quaternary ammonium salt type cationic surfactants; and nonionic surfactants including polyethylene glycol based, alkylphenol ethylene oxide adduct based and polyhydric alcohol based nonionic surfactants.

Examples of the mechanical stirring device which is used in the invention include medium-free stirrers such as ULTRATURAX (manufactured by IKA Japan K.K.), T.K. AUTO HOMO MIXER (manufactured by PRIMIX Corporation), T.K. PIPELINE HOMO MIXER (manufactured by PRIMIX Corporation), T.K. FILMICS (manufactured by PRIMIX Corporation), CLEAR MIX (manufactured by MTECHNIQUE Co., Ltd.), CLEAR SS5 (manufactured by MTECHNIQUE Co., Ltd.), CAVITRON (manufactured by EUROTEC, Ltd.), and FINE FLOW MILL (manufactured by Pacific Machinery & Engineering Co., Ltd.); and medium type stirrers such as VISCO MILL (manufactured by Aimex Co., Ltd.), APEX MILL (manufactured by Kotobuki Industries Co., Ltd.), STAR MILL (manufactured by Ashizawa Finetech Ltd.), DCP SUPERFLOW (manufactured by Nippon Eirich Co., Ltd.), MP MILL (manufactured by Inoue Mfg., Inc.), SPIKE MILL (manufactured by Inoue Mfg., Inc.), MIGHTY MILL (manufactured by Inoue Mfg., Inc.), and SC MILL (manufactured by Mitsui Mining Co., Ltd.).

In the invention, a mixed material or kneaded material containing at least a resin and a pigment is finely granulated while heating by using a mechanical stirring device. After the fine granulation, the resulting material may be once cooled to a desired temperature or may be set up at a desired temperature at which coagulation is carried out.

In the invention, in order to prepare a coarsely granulated mixture, a mixture containing a binder resin and a coloring agent can be kneaded.

A kneader which is used is not particularly limited so far as it is able to achieve melt kneading, and examples thereof include a single-screw extruder, a twin-screw extruder, a pressure kneader, a Banbury mixer, and a Brabender mixer. Concretely, there are enumerated FCM (manufactured by Kobe Steel, Ltd.), NCM (manufactured by Kobe Steel, Ltd.), LCM (manufactured by Kobe Steel, Ltd.), ACM (manufactured by Kobe Steel, Ltd.), KTX (manufactured by Kobe Steel, Ltd.), GT (manufactured by Ikegai, Ltd.), PCM (manufactured by Ikegai, Ltd.), TEX (manufactured by The Japan Steel Works, Ltd.), TEM (manufactured by Toshiba Machine Co., Ltd.), ZSK (manufactured by Warner K.K.), and KNEADEX (manufactured by Mitsui Mining Co., Ltd.).

In the invention, in the case of coagulating the fine particle, a water-soluble metal salt can be used. Examples of the water-soluble metal salt include metal salts such as sodium chloride, calcium chloride, calcium nitrate, barium chloride, magnesium chloride, zinc chloride, magnesium sulfate, aluminum chloride, and aluminum sulfate; and inorganic metal salt polymers such as poly(aluminum chloride), poly(aluminum hydroxide), and calcium polysulfide.

In the invention, in the case of coagulating the fine particle, an organic solvent may be used. Examples of the organic solvent include alcohols such as methanol, ethanol, 1-propanol, 2-propanol, 2-methyl-2-propanol, 2-methoxyethanol, 2-ethoxyethanol, and 2-butoxyethanol, acetonitrile, and 1,4-dioxane.

In the invention, in order to adjust fluidity or charge properties with respect to the toner particle, an inorganic fine particle may be added and mixed on the surface of the toner particle in an amount of from 0.01 to 20% by weight based on the total weight of the toner. As such an inorganic fine particle, silica, titania, alumina, strontium titanate, tin oxide, and so on can be used singly or in admixture of two or more kinds thereof.

From the viewpoint of an improvement of environmental stability, it is preferred to use an inorganic fine particle which has been subjected to a surface treatment with a hydrophobic agent. In addition to such an inorganic oxide, a resin fine particle of not larger than 1 μm may be externally added for the purpose of improving cleaning properties.

Examples of a mixing machine for an inorganic fine particle and the like include a Henschel mixer (manufactured by Mitsui Mining Co., Ltd.), a super mixer (manufactured by Kawata Mfg., Co., Ltd.), a conical ribbon mixer (manufactured by Okawara Mfg., Co., Ltd.), a nauta mixer (manufactured by Hosokawa Micron Corporation), a turbulizer (manufactured by Hosokawa Micron Corporation), a cyclomixer (manufactured by Hosokawa Micron Corporation), a spiral pin mixer (manufactured by Pacific Machinery & Engineering Co., Ltd.), and a Lodige mixer (manufactured by Matsubo Corporation).

In the invention, the coarse particle and the like may further be sieved. Examples of a sieve device which is used for sieving include ULTRA SONIC (manufactured by Koei Sangyo Co., Ltd.), a gyroshifter (manufactured by Tokuju Corporation), VIBRASONIC SYSTEM (manufactured by Dalton Co., Ltd.), SONICLEAN (manufactured by Shinto Kogyo Kabushiki Kaisha), TURBOSCREENER (manufactured by Turbo Kogyo Co., Ltd.), MICROSHIFTER (manufactured by Makino Mfg. Co., Ltd.), and a circular vibrating separator.

The invention will be described below in more detail with reference to the following Examples.

First of all, an example of the method for manufacturing a developing agent according to the first viewpoint of the invention will be described.

EXAMPLE 1

90 parts by weight of a polyester resin as a binder resin, 5 parts by weight of a cyan color pigment as a coloring agent, 4 parts by weight of an ester wax, and 1 part by weight of a zirconia metal complex as a charge controlling agent were mixed and then melt kneaded by a twin-screw kneader set up at a temperature of 120° C., thereby obtaining a kneaded material.

The resulting kneaded material was coarsely pulverized into a volume average particle size of 1.2 mm by a hammer mill as manufactured by Nara Machinery Co., Ltd., thereby obtaining a coarse particle.

40 parts by weight of the coarse particle, 4 parts by weight of sodium dodecylbenzenesulfonate as an anionic surfactant, 1 part by weight of triethylamine as an amine compound, and 55 parts by weight of ion exchanged water were mixed by CLEAR MIX, thereby preparing a mixed solution.

After heating the mixed solution within the CLEAR MIX to 80° C., the revolution number of the CLEAR MIX was set up at 6,000 rpm, and mechanical stirring was carried out for 30 minutes.

After completion of the mechanical stirring, the mixed solution was cooled to the ordinary temperature.

With respect to the solids of the resulting mixed solution, centrifugation using a centrifuge, removal of a supernatant and washing with ion exchanged water were repeatedly carried out, and washing was carried out until the supernatant had a conductivity of 50 μS/cm. Thereafter, drying was carried out by a vacuum dryer until the water content became 0.3% by weight, thereby obtaining a toner particle.

After drying, 2 parts by weight of hydrophobic silica and 0.5 parts by weight of titanium oxide were attached as additives to the surface of the toner particle, thereby obtaining a desired electrophotographic toner.

As a result of measuring a volume average particle size of the resulting electrophotographic toner by a Coulter counter as manufactured by Beckman Coulter Inc., it was found to be 4.5 μm; and as a result of measuring a circularity thereof by FPIA2100 as manufactured by Sysmex Corporation, it was found to be 0.98. Furthermore, the yield was 98%.

The electrophotographic toner was thrown into a complex machine e-STUDIO 281c as manufactured by Toshiba Tec Corporation, which had been modified for evaluation, the temperature of a fixing unit was intentionally changed, and the lowest temperature of the fixing unit at which a satisfactory image was obtained was evaluated. As a result, it was found to be 150° C. Furthermore, as a result of evaluation of transfer properties, it was noted that 99% of the electrophotographic toner as developed on a photoreceptor was transferred onto paper.

EXAMPLE 2

A mixture containing 36 parts by weight of a polyester resin as a binder resin, 2 parts by weight of a cyan pigment as a coloring agent, 1.6 parts by weight of an ester wax, and 0.4 parts by weight of a zirconia metal complex as a charge controlling agent was used and uniformly dispersed by a Henschel mixer as manufactured by Mitsui Mining Co., Ltd., thereby obtaining a coarse particle having a volume average particle size of 0.8 mm.

40 parts by weight of the coarse particle, 4 parts by weight of sodium dodecylbenzenesulfonate as an anionic surfactant, 1 part by weight of triethylamine as an amine compound, and 55 parts by weight of ion exchanged water were mixed by CLEAR MIX, thereby preparing a mixed solution.

After heating the mixed solution within the CLEAR MIX to 80° C., the revolution number of the CLEAR MIX was set up at 6,000 rpm, and mechanical stirring was carried out for 30 minutes.

After completion of the mechanical stirring, the mixed solution was cooled to the ordinary temperature, and the solids of the resulting mixed solution were washed by using a centrifuge and dried by a vacuum dryer until the water content became 0.3% by weight in the same manner as in Example 1, thereby obtaining a toner particle.

After drying, 2 parts by weight of hydrophobic silica and 0.5 parts by weight of titanium oxide were attached as additives to the surface of the toner particle, thereby obtaining a desired electrophotographic toner.

As a result of measuring a volume average particle size of the resulting electrophotographic toner by a Coulter counter, it was found to be 4.6 μm; and as a result of measuring a circularity thereof by FPIA2100, it was found to be 0.98. Furthermore, the yield was 98%.

With respect to this electrophotographic toner, the lowest temperature of a fixing unit at which a satisfactory image was obtained was evaluated in the same manner as in Example 1. As a result, it was found to be 150° C. Furthermore, as a result of evaluation of transfer properties, it was noted that 99% of the electrophotographic toner as developed on a photoreceptor was transferred onto paper.

EXAMPLE 3

90 parts by weight of a polyester resin, 5 parts by weight of a magenta pigment as a coloring agent, 4 parts by weight of an ester wax, and 1 part by weight of a zirconia metal complex as a charge controlling agent were mixed and then melt kneaded by a twin-screw kneader set up at a temperature of 120° C., thereby obtaining a kneaded material.

The resulting kneaded material was coarsely pulverized into a volume average particle size of 1.4 mm by a hammer mill as manufactured by Nara Machinery Co., Ltd., thereby obtaining a coarse particle.

40 parts by weight of the coarse particle, 4 parts by weight of sodium dodecylbenzenesulfonate as an anionic surfactant, 1 part by weight of triethylamine as an amine compound, and 55 parts by weight of ion exchanged water were thrown into CLEAR MIX, thereby obtaining a mixed solution.

After heating the mixed solution within the CLEAR MIX to 80° C., the revolution number of the CLEAR MIX was set up at 6,000 rpm, and mechanical stirring was carried out for 30 minutes.

After completion of the mechanical stirring, the mixed solution was cooled to the ordinary temperature, and the solids of the resulting mixed solution were washed by using a centrifuge and dried by a vacuum dryer until the water content became 0.3% by weight in the same manner as in Example 1, thereby obtaining a toner particle.

After drying, 2 parts by weight of hydrophobic silica and 0.5 parts by weight of titanium oxide were attached as additives to the surface of the toner particle, thereby obtaining a desired electrophotographic toner.

As a result of measuring a volume average particle size of the resulting electrophotographic toner by a Coulter counter, it was found to be 4.9 μm; and as a result of measuring a circularity thereof by FPIA2100, it was found to be 0.98. Furthermore, the yield was 98%.

With respect to this electrophotographic toner, the lowest temperature of a fixing unit at which a satisfactory image was obtained was evaluated in the same manner as in Example 1. As a result, it was found to be 150° C. Furthermore, as a result of evaluation of transfer properties, it was noted that 98% of the electrophotographic toner as developed on a photoreceptor was transferred onto paper.

EXAMPLE 4

90 parts by weight of a polyester resin as a binder resin, 5 parts by weight of a magenta pigment as a coloring agent, 4 parts by weight of an ester wax, and 1 part by weight of a zirconia metal complex as a charge controlling agent were mixed and then melt kneaded by a twin-screw kneader set up at a temperature of 120° C., thereby obtaining a kneaded material.

The resulting kneaded material was coarsely pulverized into a volume average particle size of 1.4 mm by a hammer mill as manufactured by Nara Machinery Co., Ltd., thereby obtaining a coarse particle.

40 parts by weight of the coarse particle, 4 parts by weight of sodium dodecylbenzenesulfonate as an anionic surfactant, and 56 parts by weight of ion exchanged water were thrown into CLEAR MIX, thereby obtaining a mixed solution.

After heating the mixed solution within the CLEAR MIX to 80° C., the revolution number of the CLEAR MIX was set up at 6,000 rpm, and mechanical stirring was carried out for 30 minutes.

After completion of the mechanical stirring, the mixed solution was cooled to the ordinary temperature, and the solids of the resulting mixed solution were washed by using a centrifuge and dried by a vacuum dryer until the water content became 0.3% by weight in the same manner as in Example 1, thereby obtaining a toner particle.

After drying, 2 parts by weight of hydrophobic silica and 0.5 parts by weight of titanium oxide were attached as additives to the surface of the toner particle, thereby obtaining a desired electrophotographic toner.

As a result of measuring a volume average particle size of the resulting electrophotographic toner by a Coulter counter, it was found to be 4.9 μm; and as a result of measuring a circularity thereof by FPIA2100, it was found to be 0.93. Furthermore, the yield was 97%.

With respect to this electrophotographic toner, the lowest temperature of a fixing unit at which a satisfactory image was obtained was evaluated in the same manner as in Example 1. As a result, it was found to be 150° C. Furthermore, as a result of evaluation of transfer properties, it was noted that 94% of the electrophotographic toner as developed on a photoreceptor was transferred onto paper.

COMPARATIVE EXAMPLE 1

90 parts by weight of a polyester resin, 5 parts by weight of a cyan pigment, 4 parts by weight of an ester wax, and 1 part by weight of a zirconia metal complex as a charge controlling agent were mixed and then melt kneaded by a twin-screw kneader set up at a temperature of 120° C., thereby obtaining a kneaded material.

After cooling and drying the resulting kneaded material, pulverization and classification were repeated by an air flow type pulverizer until the volume average particle size became 4.5 to 5.0 μm, thereby obtaining a toner particle.

2 parts of the resulting hydrophobic silica and 0.5 parts by weight of titanium oxide were attached as additives to the surface of the toner particle, whereby a desired electrophotographic toner could be obtained.

As a result of measuring a volume average particle size of the resulting electrophotographic toner by a Coulter counter, it was found to be 4.6 μm; and as a result of measuring a circularity thereof by FPIA2100, it was found to be 0.89. Furthermore, the yield was 13%.

With respect to this electrophotographic toner, the lowest temperature of a fixing unit at which a satisfactory image was obtained was evaluated in the same manner as in Example 1. As a result, it was found to be 150° C. Furthermore, as a result of evaluation of transfer properties, it was noted that 85% of the electrophotographic toner as developed on a photoreceptor was transferred onto paper.

COMPARATIVE EXAMPLE 2

In a flask, 30 parts by weight of styrene, 8 parts by weight of butyl acrylate, 2 parts by weight of acrylic acid, 1 part by weight of dodecanethiol, and 0.4 parts by weight of sodium laurylsulfate as an anionic surfactant were dispersed in 50 parts by weight of ion exchange water and emulsified, and the emulsion was heated under a nitrogen atmosphere as it was until the temperature reached 70° C. At the point of time at which the temperature reached 70° C., a solution of 0.1 parts by weight of ammonium persulfate in 8.5 parts by weight of ion exchanged water was added, and the mixture was allowed to react for 5 hours as it was, thereby obtaining a resin fine particle mixed solution. As a result of measuring a volume average particle size by SALD7000 (manufactured by Shimadzu Corporation), it was found to be 0.12 μm.

40 parts by weight of a cyan pigment, 0.4 parts by weight of an anionic surfactant, and 59.6 parts by weight of ion exchanged water were treated by a homogenizer, thereby obtaining a pigment mixed solution. As a result of measuring a volume average particle size by SALD7000 (manufactured by Shimadzu Corporation), it was found to be 0.35 μm.

40 parts by weight of an ester wax, 0.4 parts by weight of an anionic surfactant, and 59.6 parts by weight of ion exchanged water were treated by a homogenizer while heating at 90° C., thereby obtaining a wax mixed solution. As a result of measuring a volume average particle size by SALD7000 (manufactured by Shimadzu Corporation), it was found to be 0.19 μm.

40 parts by weight of a charge controlling agent, 0.4 parts by weight of an anionic surfactant, and 59.6 parts by weight of ion exchanged water were treated by a homogenizer, thereby obtaining a charge controlling agent mixed solution. As a result of measuring a volume average particle size by SALD7000 (manufactured by Shimadzu Corporation), it was found to be 0.48 μm.

90 parts by weight of the resin fine particle mixed solution, 5 parts by weight of the pigment mixed solution, 4 parts by weight of the wax mixed solution, and 1 part by weight of the charge controlling agent mixed solution were mixed.

After adding 1 part by weight of magnesium sulfate to the mixed solution, the temperature was raised to 48° C. at a rate of 1° C./min. while stirring, and the mixture was held for 2 hours. Thereafter, the temperature was raised to 70° C. at a rate of 1° C./min., thereby obtaining a colored particle. The colored particle was washed with washing water by a centrifuge until the conductivity became 50 μS/cm and then dried by a vacuum dryer until the water content became 0.3 wt %, thereby obtaining a toner particle.

After drying, 2 parts by weight of hydrophobic silica and 0.5 parts by weight of titanium oxide were attached, whereby a desired electrophotographic toner could be obtained. As a result of measuring a volume average particle size of the electrophotographic toner by a Coulter counter (manufactured by Beckman Coulter Inc.), it was found to be 4.9 μm; and as a result of measuring a circularity thereof by FPIA2100 (manufactured by Sysmex Corporation), it was found to be 0.97. Furthermore, the yield was 97%.

With respect to this electrophotographic toner, the lowest temperature of a fixing unit at which a satisfactory image was obtained was evaluated in the same manner as in Example 1. As a result, it was found to be 180° C. Furthermore, as a result of evaluation of transfer properties, it was noted that 97% of the electrophotographic toner as developed on a photoreceptor was transferred onto paper.

Next, an example of the method for manufacturing a developing agent according to the second viewpoint of the invention will be described.

EXAMPLE 5

Mechanical stirring of a mixed solution having the same composition as in Example 1 was carried out for thirty minutes in the same manner as in Example 1, except for setting up the revolution number of the CLEAR MIX at 10,000 rpm.

After cooling, the volume average particle size of a fine particle in the resulting mixed solution was measured by SALD7000 (manufactured by Shimadzu Corporation). As a result, it was found to be 0.82 μm.

2 parts by weight of magnesium sulfate was added to the resulting fine particle mixed solution, the temperature was raised to 70° C. step by step, and the fine particle was coagulated so as to have a desired volume average particle size, thereby obtaining a coagulated particle.

For the purpose of holding the volume average particle size of the colored particle, 2 parts by weight of sodium dodecylbenzenesulfonate was added as a dispersant; and for the purpose of controlling the shape, the temperature was raised to 90° C., followed by allowing it to stand for 3 hours.

After cooling, the resulting coagulated particle was washed by a centrifuge and dried by a vacuum dryer until the water content became 0.3 wt % in the same manner as in Example 1, thereby obtaining a toner particle.

After drying, 2 parts by weight of hydrophobic silica and 0.5 parts by weight of titanium oxide were attached onto the surface of the colored particle, thereby obtaining a desired electrophotographic toner.

As a result of measuring a volume average particle size of the resulting electrophotographic toner by a Coulter counter, it was found to be 4.5 μm; and as a result of measuring a circularity thereof by FPIA2100, it was found to be 0.98. Furthermore, the yield was 98%.

With respect to this electrophotographic toner, the lowest temperature of a fixing unit at which a satisfactory image was obtained was evaluated in the same manner as in Example 1. As a result, it was found to be 150° C. Furthermore, as a result of evaluation of transfer properties, it was noted that 99% of the electrophotographic toner as developed on a photoreceptor was transferred onto paper.

EXAMPLE 6

Mechanical stirring of a mixed solution having the same composition as in Example 2 was carried out for thirty minutes in the same manner as in Example 2, except for setting up the revolution number of the CLEAR MIX at 10,000 rpm.

A part of the sample was taken out while holding the temperature and cooled to 30° C. As a result of measuring a volume average particle size of the resulting fine particle by SALD7000 (manufactured by Shimadzu Corporation), it was found to be 0.96 μm.

After mechanical stirring, the fine particle was coagulated while adding hydrochloric acid to the fine particle mixed solution held at 80° C. without being cooled so as to have a desired volume average particle size, thereby obtaining a coagulated particle.

For the purpose of holding the volume average particle size of the coagulated particle, 2 parts by weight of sodium dodecylbenzenesulfonate was added as a dispersant; and for the purpose of controlling the shape, the temperature was raised to 90° C., followed by allowing it to stand for 3 hours.

After cooling, the resulting coagulated particle was washed by a centrifuge and dried by a vacuum dryer until the water content became 0.3 wt % in the same manner as in Example 1, thereby obtaining a toner particle.

After drying, 2 parts by weight of hydrophobic silica and 0.5 parts by weight of titanium oxide were attached onto the surface of the coagulated particle, thereby obtaining a desired electrophotographic toner.

As a result of measuring a volume average particle size of the resulting electrophotographic toner by a Coulter counter, it was found to be 4.6 μm; and as a result of measuring a circularity thereof by FPIA2100, it was found to be 0.98. Furthermore, the yield was 98%.

With respect to this electrophotographic toner, the lowest temperature of a fixing unit at which a satisfactory image was obtained was evaluated in the same manner as in Example 1. As a result, it was found to be 150° C. Furthermore, as a result of evaluation of transfer properties, it was noted that 99% of the electrophotographic toner as developed on a photoreceptor was transferred onto paper.

EXAMPLE 7

Mechanical stirring of a mixed solution having the same composition as in Example 3 was carried out for thirty minutes in the same manner as in Example 3, except for setting up the revolution number of the CLEAR MIX at 10,000 rpm. A part of the sample was taken out and cooled to 30° C., and a volume average particle size of the resulting fine particle by SALD7000 (manufactured by Shimadzu Corporation) was then measured. As a result, it was found to be 1.3 μm.

In a state that the temperature of the sample was dropped from 80° C. to 60° C., 3 parts by weight of a cationic surfactant (lauryltrimethylammonium chloride) was added to the resulting fine particle mixed solution, and the fine particle was coagulated so as to have a desired volume average particle size, thereby obtaining a coagulated particle.

For the purpose of holding the volume average particle size of the coagulated particle, a dispersant was added; and for the purpose of controlling the shape, the temperature was raised to 90° C., followed by allowing it to stand for 3 hours.

After cooling, the resulting colored particle was washed by a centrifuge and dried by a vacuum dryer until the water content became 0.3 wt % in the same manner as in Example 1, thereby obtaining a toner particle.

After drying, 2 parts by weight of hydrophobic silica and 0.5 parts by weight of titanium oxide were attached onto the surface of the colored particle, thereby obtaining a desired electrophotographic toner.

As a result of measuring a volume average particle size of the resulting electrophotographic toner by a Coulter counter, it was found to be 4.5 μm; and as a result of measuring a circularity thereof by FPIA2100, it was found to be 0.98. Furthermore, the yield was 98%.

With respect to this electrophotographic toner, the lowest temperature of a fixing unit at which a satisfactory image was obtained was evaluated in the same manner as in Example 1. As a result, it was found to be 150° C. Furthermore, as a result of evaluation of transfer properties, it was noted that 98% of the electrophotographic toner as developed on a photoreceptor was transferred onto paper.

EXAMPLE 8

A colored particle was obtained in the same manner as in Example 7, except for setting up the holding time for controlling the shape of the coagulated particle at one hour.

After cooling, the resulting colored particle was washed by a centrifuge and dried by a vacuum dryer until the water content became 0.3 wt % in the same manner as in Example 1, thereby obtaining a toner particle.

After drying, 2 parts by weight of hydrophobic silica and 0.5 parts by weight of titanium oxide were attached onto the surface of the coagulated particle, thereby obtaining a desired electrophotographic toner.

As a result of measuring a volume average particle size of the resulting electrophotographic toner by a Coulter counter, it was found to be 4.6 μm; and as a result of measuring a circularity thereof by FPIA2100, it was found to be 0.92. Furthermore, the yield was 98%.

With respect to this electrophotographic toner, the lowest temperature of a fixing unit at which a satisfactory image was obtained was evaluated in the same manner as in Example 1. As a result, it was found to be 150° C. Furthermore, as a result of evaluation of transfer properties, it was noted that 91% of the electrophotographic toner as developed on a photoreceptor was transferred onto paper.

It was noted from Examples 7 and 8 that according to the invention, the shape of the toner can be arbitrarily controlled.

EXAMPLE 9

Mechanical stirring was carried out for 30 minutes in the same manner as in Example 5, except for not adding the anionic surfactant to the coarse particle of the kneaded material and changing the composition of the ion exchange water to 56 parts by weight.

A part of the sample was taken out and cooled to 30° C., and a volume average particle size of the resulting fine particle was then measured by SALD7000 (manufactured by Shimadzu Corporation). As a result, it was found to be 2.6 μm. In a state that the temperature of the sample was dropped from 80° C. to 60° C., 2 parts by weight of magnesium sulfate was added to the resulting fine particle mixed solution, and the fine particle was coagulated so as to have a desired volume average particle size, whereby a colored particle could be obtained.

For the purpose of holding the volume average particle size of the colored particle, a dispersant was added; and for the purpose of controlling the shape, the temperature was raised to 90° C., followed by allowing it to stand for 3 hours. After cooling, the resulting colored particle was washed by a centrifuge until the conductivity of the washing water became 50 μS/cm, and then dried by a vacuum dryer until the water content became 0.3 wt %.

After drying, 2 parts by weight of hydrophobic silica and 0.5 parts by weight of titanium oxide were attached onto the surface of the colored particle, thereby obtaining a desired electrophotographic toner.

As a result of measuring a volume average particle size of the resulting electrophotographic toner by a Coulter counter, it was found to be 4.9 μm; and as a result of measuring a circularity thereof by FPIA2100, it was found to be 0.95. Furthermore, the yield was 98%.

This electrophotographic toner was thrown into a complex machine e-STUDIO 281c as manufactured by Toshiba Tec Corporation, which had been modified for evaluation, the temperature of a fixing unit was intentionally changed, and the lowest temperature of the fixing unit at which a satisfactory image was obtained was evaluated. As a result, it was found to be 150° C. Furthermore, as a result of evaluation of transfer properties, it was noted that 95% of the electrophotographic toner as developed on a photoreceptor was transferred onto paper.

The results of each of the evaluations of the developing agents as obtained in the foregoing Examples 1 to 4 and Comparative Examples 1 and 2 are shown in the following Table 1.

TABLE 1

| | Particle size of coarse particle (mm) | Particle size of toner particle (μm) | Circularity | Yield (%) | Fixing temperature (° C.) | Transfer efficiency (%) | Overall evaluation |
|---|---|---|---|---|---|---|---|
| Example 1 | 1.2 | 4.5 | 0.98 | 98 | 150 | 99 | Good |
| Example 2 | 0.8 | 4.6 | 0.98 | 98 | 150 | 99 | Good |
| Example 3 | 1.4 | 4.9 | 0.98 | 98 | 150 | 98 | Good |
| Example 4 | 1.4 | 4.9 | 0.93 | 97 | 150 | 94 | Good |
| Comparative Example 1 | 1.2 | 4.6 | 0.89 | 27 | 150 | 85 | Bad |
| Comparative Example 2 | — | 4.9 | 0.97 | 97 | 180 | 97 | Moderate |

As shown in Table 1, the developing agents as obtained by using the method of the invention were satisfactory with respect to all of the circularity, yield, fixability and transfer efficiency as compared with those of Comparative Example 1 using a pulverization method and Comparative Example 2 using an emulsion polymerization method. In comparison with Example 3 in which an amine compound is added, Example 4 in which an amine compound is not added was somewhat lowered with respect to the circularity and transfer efficiency but did not produce a problem in practical use.

Furthermore, the results of the evaluations of the developing agents as obtained in the foregoing Examples 5 to 9 are shown in the following Table 2.

TABLE 2

| | Particle size of coarse particle (mm) | Particle size of toner particle (μm) | Circularity | Yield (%) | Fixing temperature (° C.) | Transfer efficiency (%) | Overall evaluation |
|---|---|---|---|---|---|---|---|
| Example 5 | 1.2 | 4.5 | 0.98 | 98 | 150 | 99 | Good |
| Example 6 | 0.8 | 4.6 | 0.98 | 98 | 150 | 99 | Good |
| Example 7 | 1.4 | 4.5 | 0.98 | 98 | 150 | 98 | Good |
| Example 8 | 1.4 | 4.6 | 0.92 | 98 | 150 | 91 | Good |
| Example 9 | 1.4 | 4.9 | 0.95 | 98 | 150 | 95 | Good |

As shown in Table 2, in Examples 5, 6 and 7, by making the revolution number of the CLEAR MIX higher than that in Examples 1, 2 and 3, it was possible to prepare a fine particle having a size smaller than that of the fine particles as obtained in Examples 1, 2 and 3. Furthermore, it was noted that by coagulating a fine particle having a small size, a toner particle having a desired size was obtained.

Moreover, it was noted that the circularity could be adjusted by decreasing the holding time for controlling the shape in Example 8 and not adding an anionic surfactant at the time of mechanical stirring in Example 9, respectively.

The invention can also be applied to a wet electrophotographic system in a state of a mixed solution in addition to the use as a powder because it is suitable for manufacturing a colored particle having a small particle size.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for manufacturing a developing agent, comprising:

melt kneading and pulverizing a mixture containing at least a binder resin and a coloring agent to form a granulated mixture having a first volume average particle size;

mixing the granulated mixture with an aqueous medium to form a mixed solution;

mechanically stirring the mixed solution to finely granulate said granulated mixture to form a fine particle having a second volume average particle size small than the first volume average size; and coagulating the fine particle to form a coagulated particle having a third volume average particle size smaller than the first volume average size and larger than the second volume average particle size.

2. The method for manufacturing a developing agent according to claim 1, wherein first volume average particle size is 0.05 to 10 mm.

3. The method for manufacturing a developing agent according to claim 1, wherein the mechanical stirring is carried out at a temperature of a glass transition point of the binder resin or higher.

4. The method for manufacturing a developing agent according to claim 1, wherein in the step for mixing the mixture with an aqueous medium, at least one member of a surfactant and a pH adjuster is added to the aqueous medium.

5. The method for manufacturing a developing agent according to claim 4, wherein the pH adjuster is an amine compound.

6. The method for manufacturing a developing agent according to claim 4, wherein the surfactant is an anionic surfactant.

7. The method for manufacturing a developing agent according to claim 1, wherein the second volume average particle size is 0.05 to 10 μm.

8. The method for manufacturing a developing agent according to claim 1, wherein the third volume average particle size is 1 to 15 μm.

9. The method for manufacturing a developing agent according to claim 1, wherein the coagulated particle has a circularity of from 0.8 to 1.0.

10. The method for manufacturing a developing agent according to claim 1, wherein the granulated mixture contains at least one of a wax and a charge controlling agent.

11. The method for manufacturing a developing agent according to claim 1, wherein the binder resin has an acid value of 1 or more.

12. The method for manufacturing a developing agent according to claim 1, wherein in the step for forming a coagulated particle, a plural number of the fine particle is coagulated by employing at least one process among adjustment of pH, addition of a surfactant, addition of a water-soluble metallic salt, addition of an organic solvent, and temperature adjustment.

13. A developing agent containing a coagulated particle of fine particles which are obtained by melt kneading and pulverizing a mixture containing a binder resin and a coloring agent, mixing the resulting granulated mixture with an aqueous medium and mechanically stirring the mixture, wherein the granulated mixture has a first volume average particle size, and the fine particle has a second volume average particle size smaller than the first volume average particle size, and the coagulated particle has a third volume average particle size smaller than the first volume average particle size and larger than the second volume average particle size.

14. The developing agent according to claim 13, wherein the first volume average particle size is 0.05 to 10 mm.

15. The developing agent according to claim 13, wherein the second volume average particle size is 0.005 to μm.

16. The developing agent according to claim 13, wherein the third volume average particle size is 1 to 15 μm.

* * * * *